United States Patent [19]

Berlin, deceased et al.

[11] 4,221,167

[45] Sep. 9, 1980

[54] DELAY BURSTER FOR A PROJECTILE

[75] Inventors: Aaron S. Berlin, deceased, late of Wilmington, Del.; by Sara L. Berlin, executrix, Wilmington, Del.; by Howard M. Berlin, executor, Newark, Del.; Vincent C. Little, Fallston; Toney E. Leadore, Havre de Grace, both of Md.

[73] Assignee: The United States of America as represented by the Secretary of the Army, Washington, D.C.

[21] Appl. No.: 951,550

[22] Filed: Oct. 16, 1978

[51] Int. Cl.[3] ..... F42B 13/50

[52] U.S. Cl. ..... 102/69; 102/37.6

[58] Field of Search ..... 102/7.2, 69, 34.4, 37.6

[56] References Cited

U.S. PATENT DOCUMENTS

| | | | |
|---|---|---|---|
| 3,712,229 | 1/1973 | Schock | 102/69 |
| 3,750,575 | 8/1973 | Heede et al. | 102/69 |
| 3,954,060 | 5/1976 | Haag et al. | 102/69 |

*Primary Examiner*—Leland A. Sebastian

*Attorney, Agent, or Firm*—Nathan Edelberg; Robert P. Gibson; Max Yarmovsky

[57] ABSTRACT

A short delay burster for a canister ejecting projectile utilizes a multi-mesh screen operatively disposed in a choke configuration housing and held therein by an orificed retainer to permit the delay to be initiated by an expulsion charge while withstanding the high pressure shock wave of the expulsion charge explosion.

9 Claims, 2 Drawing Figures

DELAY BURSTER FOR A PROJECTILE

GOVERNMENTAL INTEREST

The invention described herein may be manufactured, used and licensed by or for the Government for governmental purposes without the payment to me of any royalty thereon.

BACKGROUND OF THE INVENTION

Various means have been used in the prior art to eject a canister from a rocket fired or artillery fired projectiles in order to accurately dispense the projectile's warhead cargo accurately over the target area. The canister was generally required to be ejected from the projectile, after the projectile began to slow down in flight, in order to achieve the necessary range. Then the canister had to be opened within one to two tenths of a second, after ejection from the parent munition, in order to maintain flight direction and accuracy in hitting the intended target. The prior art device frequently used electrical, mechanical and/or electrical-mechanical devices to accomplish properly sequenced canister ejection. The problem with these prior art devices was that usually the pressure build up caused by the expulsion charge was so great that it would destroy the electrical, or electromechanical devices thus preventing properly timed activation and release. The above problems are particularly acute in 2–3 inch diameter rockets and 155 mm artillery fired projectile having smoke screening warheads which utilize white phosphorus as a smoke generating agent.

SUMMARY OF THE INVENTION

The present invention relates to short delay burster for a cannister ejecting projectile having a shielded multi-screened delay column disposed in a choke configured delay housing. The delay burster is designed to withstand the high pressure forces of an expulsion charge while assuring initiation of the delay and proper opening of the canister.

An object of the present invention is to provide a short delay burster for canister ejecting projectile which will reliably permit the projectile payload to be dispersed over an intended target area.

Another object of the present invention is to provide a short delay burster for a canister ejecting projectile which will insure against a delay column, used to initiate opening of a canister, from being blown away by the explusion charge.

Another object of the present invention is to provide a short delay burster for a canister ejecting projectile which can open a dispensing canister within 1 to two tenths of a second after ejection.

A further object of the present invention is to provide a short delay burster for a canister ejecting projectile which will reliably maintain the projectile's flight direction and effectiveness over the target area.

For a better understanding of the present invention, together with other and further objects thereof, reference is made to the following descriptions taken in connection with the accompanying drawings.

BRIEF DESCRIPTION OF THE DRAWINGS

Throughout the following description like reference numerals are used to denote like parts of the drawings.

DESCRIPTION OF THE PREFERRED EMBODIMENTS

Figure 1:
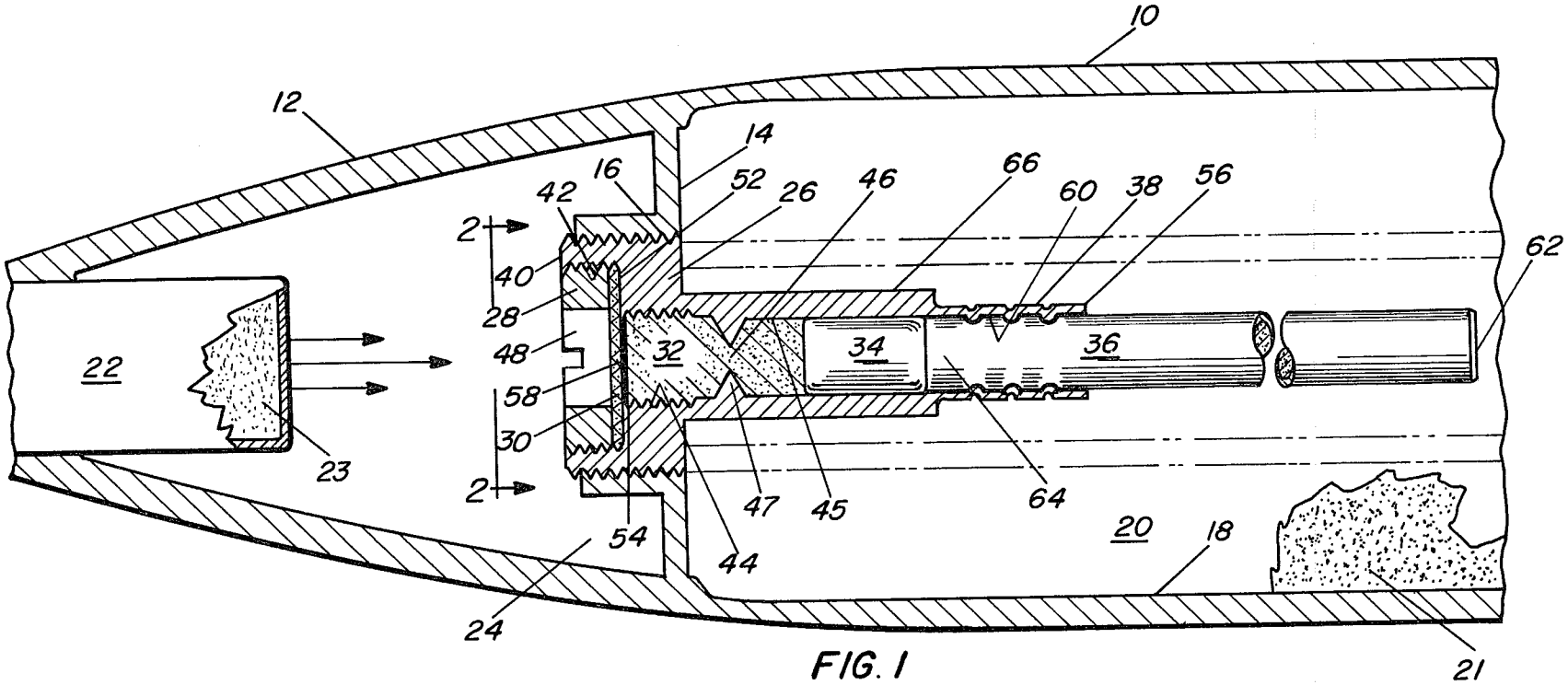
FIG. 1 is a partial longitudinal cross-sectional view of the delay burster assembly positioned in an artillery fired projectile.
Figure 2:
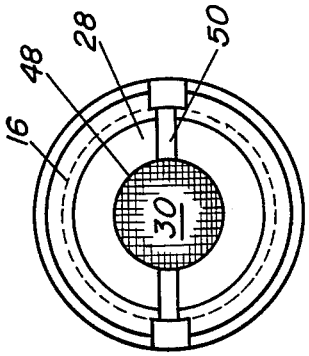
FIG. 2 is an end view taken along line 2—2 of FIG. 1.

Referring now to FIGS. 1 and 2, a tubularly shaped projectile housing 10 has a forward ogive end 12 and a transverse bulkhead 14 having an internally threaded axially aligned bore 16 positioned therein. Bulkhead 14 transversely separates the forward ogive end 12 from a main cylindrically shaped cargo cavity 18 which contains an ejectable cylindrically shaped container 20 containing smoke generating chemicals such as white phosphorus 21. Expulsion-initiating charge 22, fixedly axially positioned in forward ogive end 12, has an explosive material 23 therein whose high pressure gas output is directed toward an axially positioned delay burster assembly 24 and cannister 20. Delay burster assembly 24 main elements comprise a choke housing member 26, a retainer member 28, a multi-mesh filter screen stack 30, an ignition composition 32, a detonator 34, and a length primacord of 36 crimped to the necked down rear end 38 of choke housing 26. The choke housing 26 has an externally threaded front end 40 fixedly screwed into bulkhead core 16. An internally threaded axial counterbore 42 communicates with an axial choke cavity 44, which in turn communicates with a second axial cavity which has a restricting orifice 46 created by the circular inwardly protruding interior wall section 47. The ignition composition 32 may be a gasless ignition powder such as type TYP A-1A, MIL-P-22264 with an additive of 1% varnish. The detonator 34 disposed intermediate ignition composition 32 and primacord 36 may be a type M35, as defined in MIL-D-46207. Primacord satisfactory for this application may be primacord 100 grain PETN/FT such as manufactured by Ensign-Bricford Co., Simsbury, Conn. The circular externally threaded retainer member 28 has an axial ignition bore 48 therein and a slotted front end 50 to permit clamping of filter screen stack 30 intermediate retainer member 28 and shoulder 52 of housing member 26. The filter screens are made of 304 stainless steel wire mesh. The stack is composed of four different size meshes arranged in the following sequential order. A first mesh having 24×24 holes to the square inch made of 0.016 inch diameter wire, a second mesh having 100×100 holes to the square inch made of 0.0035 inch diameter wire, a third mesh having 50×250 holes to the square inch size made of 0.0045 to 0.0055 inch diameter wire, and a fourth mesh size having 50×50 holes to the square inch made of 0.009 inch diameter wire. The first 24×24 filter screen mesh is positioned in abutment with retainer member 28 and the 50×50 mesh size filter screen is operatively positioned in abutment with the shoulder 52 and ignition composition 32.

The delay burster assembly 24 is assembled by loading the ignition composition 32 into the choke cavity 44 and axial cavity 45 in two increments at 1800 lb dead load pressure. The first increment is press loaded into the choke housing 26 through threaded end 54 of choke cavity 44. The second increment is press loaded into axial cavity 45 through the bottom end 56 of necked down rear end section 38. The front surface of ignition composition 32 is coated with a nitrocellulose cement 58, MIL-A-32484, Type I to form a moisture proof seal thereon. Prior to crimping the necked down rear end housing 38 on primacord 36 the front peripheral surface 60 and the rear end 62 are coated with the aforementioned nitrocellous cement. Dentonator 34 is then loaded into rear end 56 and pushed forward until it is in abutment with ignition composition 32. The front end 64 of primacord 36 after being coated with nitrocellulous cement is pushed into the bottom open end 56 until it is in abutment with detonator 34 and given a 360° crimp. The next step of the delay burster subassembly operation is to load the filter screen stack 30 with the 24×24 mesh facing the retainer member 28. The final step of subassembly for the delay burster is to threadedly screw retainer member 28 into threaded axial counterbore 42 so that it is in firm contact with the 24×24 mesh element. The delay burster assembly 24 is then operatively threaded into the bulkhead internally threaded bore 16 so that its longitudinal axis is in axial alignment with the longitudinal axis of cylindrical canister 20.

In operation after the projectile 10 is launched and has traveled sufficiently toward the target area a fuzing system not shown initiates the canister expulsion charge 22 which simultaneously initiates ignition composition 32 through axial ignition bore 48. The restriction 46 prevents the delay column 32 from being blown through the tubular delay housing midsection 66. The multi-filter screen stack prevents the top of the ignition composition charge 32 from being eroded away and enables the delay burster assembly 24 to operate so that the canister 20 is opened within one to two tenth seconds after ejection, thus permitting the projectile to maintain proper flight direction until the warhead has reached the intended target area.

While there has been described and illustrated specific embodiments of the invention, it will be obvious that various changes, modification and additions can be made herein without departing from the field of the invention which should be limited only by the scope of the appended claims.

Having thus fully described the invention, what is claimed as new and desired to be secure by Letters Patent of the United States is:

1. A projectile for reliably ejecting a payload from a canister over a selected target area which comprises:

a tubularly shaped projectile housing having a forward ogive end, a main cylindrical cargo cavity, and transverse bulkhead means fixedly positioned intermediate said ogive end and said main cargo cavity;

canister means operatively disposed within said main cargo cavity for holding said payload until said payload is released from said canister means over said target area;

expulsion-initiating charge means, axially positioned in said ogive forward end, for simultaneously ejecting said canister means and initiating the opening of said canister means when said projectile is over said target area; and delay burster means, operatively disposed in said bulkhead means in axial alignment with said expulsion-initiating charge means, adapted to be initiated by said expulsion-initiating charge without being blown away and for opening said canister means after said canister means has ejected from said projectile, which includes;

a tubularly shaped housing member having an externally threaded front end fixedly attached to said bulkhead means, said front end having an internally threaded axial counterbore, a tubular midsection having and an axial choke cavity therein which communicates with said counterbore, a second axial cavity communicates with said axial choke cavity through a restricted orifice, and a necked-down tubular bottom end;

delay burster ignition charge disposed in said axial choke cavity and said second axial cavity;

filter means operatively positioned in said internally threaded axial counterbore in abutment with a forward end of said delay burster ignition charge, for preventing said delay burster ignition charge from being blow out of said delay burster means and from being eroded away by said high pressure gases of said expulsion-initiating charge means;

retainer means threadedly screwed into said internally threaded axial counterbore for holding said filter screen means fixedly against a front end of said delay burster ignition charge;

a detonator disposed in a rear end of said tubular midsection having a forward end in abutment with a rear end of said delay burster ignition charge; and a length of primacord having a front end operatively crimped to said necked down tubular bottom end of said tubularly shaped housing member.

2. A projectile as recited in claim 1 wherein said payload of said canister means comprises a cylindrically shaped container containing white phosphorus therein.

3. A projectile as recited in claim 1 wherein said explusion-initiating charge means comprises an explosive means for generating high pressure gases.

4. A projectile as recited in claim 1 wherein said delay burster ignition charge comprises a gasless ignition powder with a 1% varnish additive.

5. A projectile as recited in claim 4 wherein said gasless ignition charge comprises a compressed gasless ignition charge adapted to be loaded into said axial choke cavity and said second axial cavity under 1800 lb. dead load pressure.

6. A projectile as recited in claim 5 wherein said filter means comprises:

a first mesh screen having 24×24 holes to the square inch made of 0.016 inch diameter wire;

a second mesh screen having 100×100 holes to the square inch made of 0.0035 inch diameter wire;

a third mesh screen having 50×50 holes to the square inch made of 0.0045 to 0.0055 inch diameter wire; and a fourth mesh screen having 50×50 holes to the square inch made of 0.009 inch diameter wire, said first mesh screen operatively positioned in abutment with one side of said retainer means and another side in abutment with one side of said second mesh screen, each of said first, second, third and fourth mesh screens being sequentially in abutment with each other.

7. A projectile as recited in claim 6 wherein said filter means comprises a plurality of different size wire mesh screens made of 304 stainless steel material.

8. A projectile as recited in claim 7 wherein said front end surface of said delay burster ignition charge includes a nitrocellulose cement coating deposited thereon.

9. A projectile as recited in claim 8 wherein said front end of said primacord includes a nitrocellulose cement coating peripherially disposed thereon prior to said primacord being crimped to said necked down tubular bottom end of said housing member.

* * * * *